United States Patent [19]

Hoffman et al.

[11] Patent Number: 4,908,588

[45] Date of Patent: Mar. 13, 1990

[54] MATRIX SWITCH

[75] Inventors: Jerzy Hoffman, Marina del Ray; Krzysztof J. Ciezarek, Sherman Oaks, both of Calif.

[73] Assignee: Hu Development Corporation, Santa Monica, Calif.

[21] Appl. No.: 202,049

[22] Filed: Jun. 2, 1988

[51] Int. Cl.[4] ..... H01P 1/10; H01P 5/12; H01H 63/00

[52] U.S. Cl. ..... 333/105; 335/5

[58] Field of Search ..... 200/175-180, 200/18, 153 S, 504; 335/415; 340/825.79; 333/101, 104, 105, 258, 259, 262, 100

[56] References Cited

U.S. PATENT DOCUMENTS

| | | | |
|---|---|---|---|
| 3,087,125 | 4/1963 | Scholefield | 335/5 X |
| 4,070,637 | 1/1978 | Assal et al. | 333/105 |
| 4,496,806 | 1/1985 | Maenishi et al. | 335/5 X |
| 4,595,893 | 6/1986 | Charbonnier et al. | 333/262 X |
| 4,697,056 | 9/1987 | Hoffman | 335/5 X |

*Primary Examiner*—J. R. Scott

*Attorney, Agent, or Firm*—Spensley, Horn, Jubas & Lubitz

[57] ABSTRACT

A matrix switch is provided having a plurality of input and output conductors adjacent each other such that an input connector may be connected to one of many output connectors upon actuation of a single movable conductor. Transfer conductors disposed adjacent to the input and output connectors allows the input connector to be electrically coupled to the remaining output connectors.

12 Claims, 11 Drawing Sheets

300

MATRIX SWITCH

BACKGROUND OF THE INVENTION

1. Field of the Invention

The present invention relates to switches, and more particularly, to matrix switches for RF applications.

2. Description of Related Art

Matrix switches have a plurality of inputs and a plurality of outputs in which any one input can be connected to any one output. Consequently, matrix switches are very useful devices for routing signals. For switching radio frequency (RF) signals, one prior matrix switch comprises a plurality of single pole, multiple throw input switches which are coupled by cables to a plurality of single pole, multiple throw output switches. For example, a 4×4 switch matrix has four inputs and four outputs in which any one of the four inputs can be connected to any one of the four outputs. For RF applications, it is preferable that any one input not be connected to more than one output and vice-versa. In one design, each of the four inputs is connected to one of four single pole, four throw input switches. Each output of the matrix switch is similarly connected to one of four single pole, four throw output switches. Each single pole, four throw input switch has four reed conductors, each reed conductor for selectively connecting the switch input terminal to one of four output terminals. Each output terminal of each input switch is connected by coaxial cable to one of four input terminals of one of the four output switches. Each output switch has four reed conductors for coupling one of the four input terminals to the output terminal of the output switch. Thus, a 4×4 matrix switch can have as many as thirty-two (32) reed conductors (eight (8) switches, four (4) reed conductors per switch) and sixteen (16) coaxial cables connecting the sixteen (16) outputs of the four (4) input switches to the sixteen (16) inputs of the four (4) output switches. It is readily seen that such a matrix switch is quite complicated and therefore costly and subject to reliability problems. Moreover, it is also quite bulky and heavy which can be very disadvantageous in weight sensitive environments such as those found aboard aircraft. Still further, each of the 32 reed conductors may require a separate solenoid to actuate the reed conductors. This further adds to the weight and expense of the switch.

SUMMARY OF THE INVENTION

It is an object of the present invention to provide an improved matrix switch, obviating, for practical purposes, the above mentioned limitations, particularly in a manner requiring a relatively uncomplicated electromechanical arrangement.

These and other objects and advantages are achieved in a matrix switch having a plurality of terminals, each terminal being electrically connected to an input/output connector. The terminals may be selectively, electrically connected together to electrically connect one connector to another connector by a movable conductor which engages two adjacent contact terminals. The switch further has a plurality of transfer conductors placed adjacent to the connector contact terminals. A second plurality of movable conductors are provided to selectively, electrically couple connector contact terminals to the appropriate transfer conductors. In the illustrated embodiment, transfer conductors are electrically connected in pairs so that upon actuation of a selected pair of movable conductors, one connector can be electrically connected to another connector via the transfer conductor pair and an actuated pair of movable conductors. As will be made more clear in connection with the accompanying drawings and detailed description, such an arrangement allows a significant reduction in the complexity of a matrix switch with a concomitant savings in size and cost and further resulting in increased reliability.

In an alternative embodiment, the matrix switch includes a plurality of input switches, each switch having a plurality of output terminals. The switch matrix further includes a plurality of reed lines, each reed line comprising a plurality of reed conductors coupled in series to an output connector. Each reed line is positioned so that each conductor reed of the reed line is placed in registration with an output terminal of an input switch. Consequently, upon actuation of an appropriate conductor reed of the reed line, the output of the input switch can be electrically connected to the output connector of the reed line. Such an arrangement also significantly reduces the complexity, size and weight of prior matrix switches.

DETAILED DESCRIPTION OF THE DRAWINGS

Figure 1:
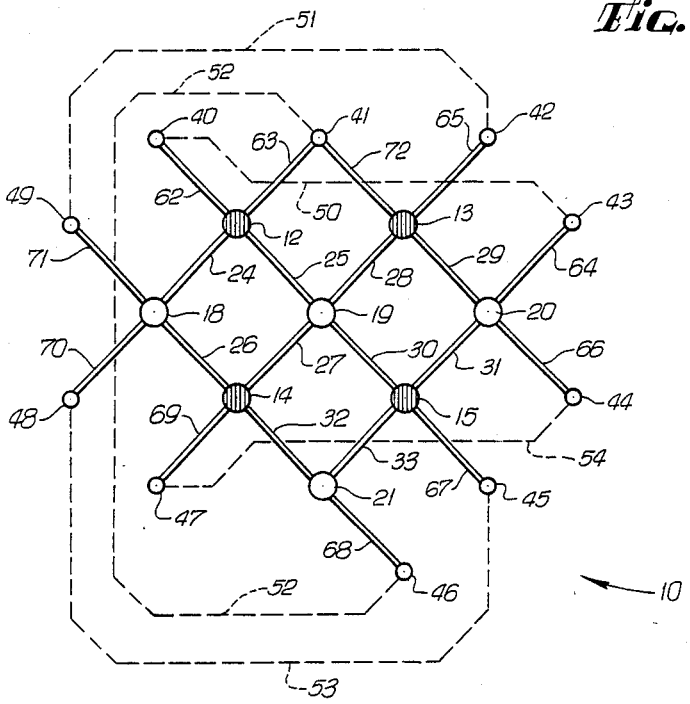
FIG. 1 is a schematic diagram of a 4×4 switch matrix in accordance with a preferred embodiment of the present invention.
Figure 3:
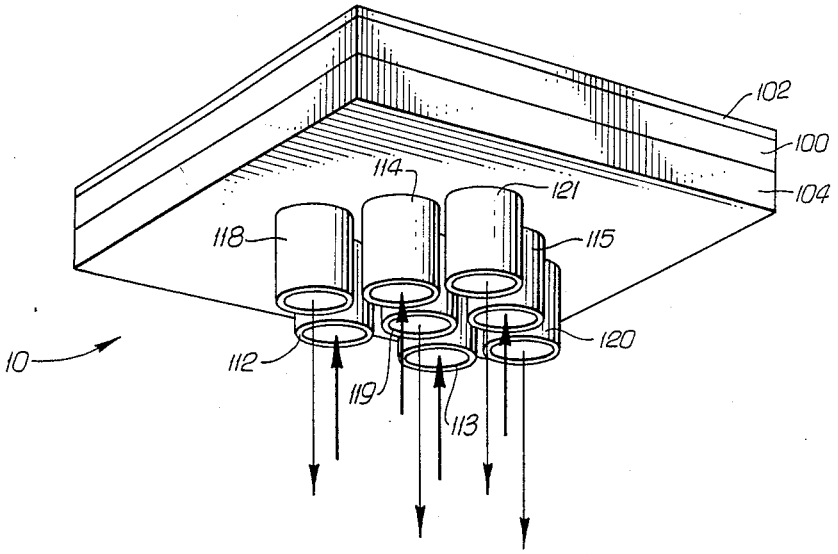
FIG. 3 is a bottom isometric view of the switch matrix of FIG. 2 illustrating the input/output connectors of the switch.

FIG. 1 depicts a schematic representation of a 4×4 matrix switch in accordance with a preferred embodiment of the present invention. The matrix switch indicated generally at 10 includes four (4) input contact terminals 12–15, each of which is electrically connected to one of four input connectors 112–115 (FIG. 3) for receiving a signal cable. The matrix switch 10 further includes four (4) output contact terminals 18–21, each of which is electrically connected to an output connector 118–121 (FIG. 3). Although the contact terminals 12–15 are referred to as "input" terminals, these terminals can function equally as output terminals. The converse is true for the output contact terminals 18–21 as well.

In the illustrated embodiment, the input contact terminals 12–15 and output contact terminals 18–21 are arranged in an orthogonal grid. The input contact terminals 12–15 are shaded dark for purposes of clarity.

The input connector 112 associated with the input contact terminal 12 may be electrically connected to the output connector 118 associated with the output contact terminal 18 by moving a single movable conductor or reed conductor 24 into engagement with both the input contact terminal 12 and the output contact terminal 18. Alternatively, the input connector 112 associated with input contact terminal 12 can be readily connected to the output connector 119 associated with the output contact terminal 19 by actuating a single reed conductor 25 to engage the contact terminals 12 and 19. As is apparent from FIG. 1, the output contact terminals 18 and 19 are adjacent to the input contact terminal 12 in the grid. Similarly, the connector 114 associated with the input contact terminal 14 may be readily connected to either the output connector 118 or 119 (associated with the output contact terminal 18 or the output contact terminal 19, respectively) upon actuation of the appropriate single conductor reed 27 or 28. It is seen that the placement of the input and output contact terminals as shown allows the input contact terminals 12–15 to be readily and selectively coupled to most of the output contact terminals 18–21 upon actuation of a single conductor reed at a time for each input terminal.

However, in the grid of FIG. 1, not all output contact terminals are placed adjacent to each and every input contact terminal. In order to allow the input contact terminals to be selectively, electrically coupled to the remaining output contact terminals, the matrix switch 10 further includes a plurality of transfer contact terminals 40–49 at the periphery of the grid. As shown in FIG. 1, the transfer contact terminals are electrically connected in pairs as represented by the dotted conductor line 50, for example, which electrically connects transfer contact terminal 40 to transfer contact terminal 43. The transfer contact terminal 40 is placed adjacent to the input contact terminal 12 and the transfer contact terminal 43 is adjacent to the output contact terminal 20. Consequently, upon activation of a conductor reed 62 to electrically couple the input contact terminal 12 to the transfer contact terminal 40 and upon actuation of a conductor reed 64 electrically coupling the transfer contact terminal 43 to the output contact terminal 20, the connector 112 associated with the input contact terminal 12 is electrically coupled to the output connector 120 associated with the output contact terminal 20. In this manner, upon actuation of the appropriate conductor reed or reed conductors, a signal transmitted to an input contact terminal from its associated input connector can be routed to any one of the four (4) output contact terminals 18–21 and to the associated output connector.

Upon inspection of FIG. 1, it is seen that the matrix switch 10 has only twenty-one (21) reed conductors as compared to thirty-two (32) reed conductors of many prior 4×4 matrix switches of the prior art. Furthermore, the matrix switch 10 has only five (5) connecting lines as compared to the sixteen (16) connector cables required by many 4×4 matrix switches of the prior art.

Figure 2:
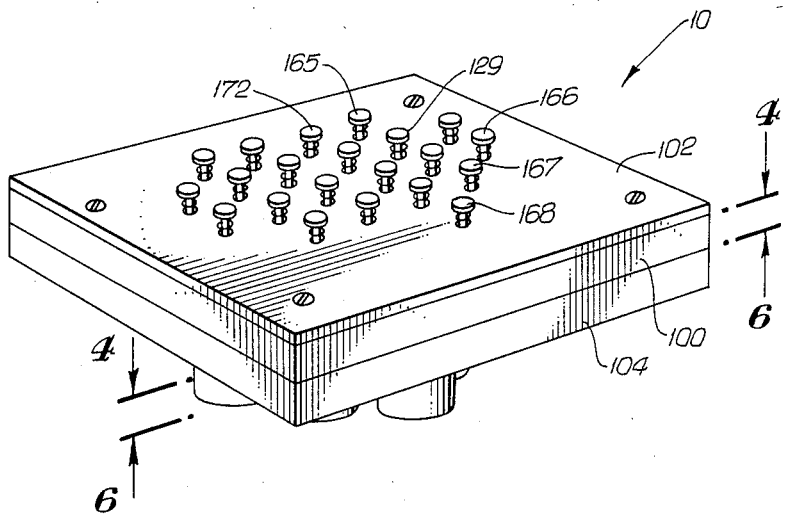
FIG. 2 is an isometric view of the matrix switch of FIG. 1, illustrating the reed actuators extending through the top of the switch.

FIGS. 2 and 3 illustrate one physical embodiment of the matrix switch 10 schematically represented in FIG. 1. The matrix switch 10 is shown in assembled form and includes a body 100 sandwiched between a top cover 102 and a bottom cover 104. As best seen in FIG. 3, the bottom cover 104 carries a plurality of input/output connectors 112–115 and 118–121. In the illustrated embodiment, the connectors 112–115 and 118–121 are "SMA" type connectors which allow RF coaxial cables to be connected to the matrix switch 10. The cables (not shown) conduct the RF signals to and from the matrix switch 10. Although the matrix switch 10 is shown utilizing coaxial type connectors, it is recognized, of course, that a matrix switch in accordance with the present invention may be used with a variety of different connectors and signal conductors.

Figure 4:
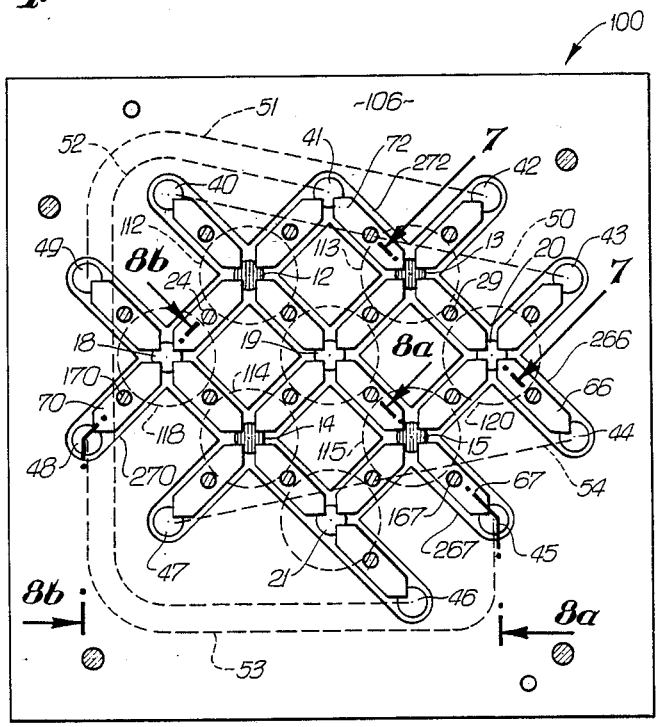
FIG. 4 is a top cross-sectional view of the switch of FIG. 2 viewed along the lines 4—4 of FIG. 2 and illustrating the reed conductors of the switch of FIG. 2.

FIG. 4 is a cross-sectional view of the matrix switch 10 showing the top surface 106 of the matrix switch body 100. As shown therein, the body 100 defines a plurality of RF cavities 224–231 and 262–270 which are arranged in an orthogonal array. Each of the reed conductors 24–31 and 62–70 is suspended in an associated cavity 224–231 and 262–270. At each intersection of the array of cavities is placed one of the contact terminals 12–15 and 18–21.

Figure 7:
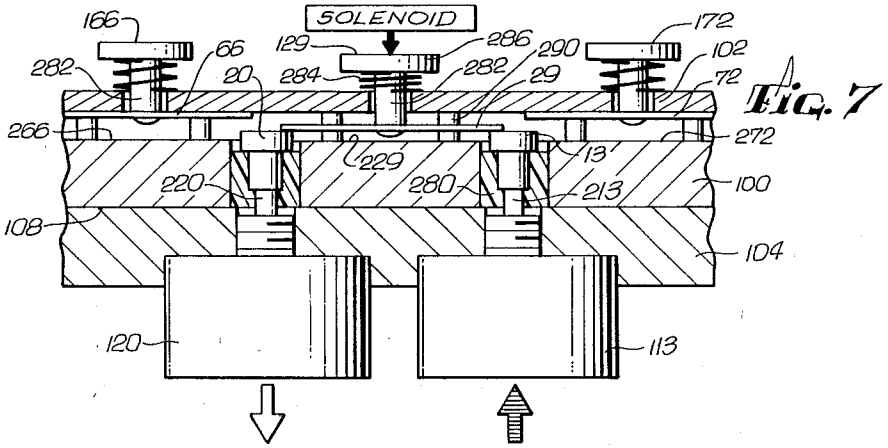
FIG. 7 is a cross-sectional view of the reed conductors and connector conductors viewed along the lines 7—7 of FIGS. 4 and 5.

As previously mentioned, the contact terminals 12–15 have been designated as "input" terminals and the contact terminals 18–21 have been designated as "output" terminals. Each of the contact terminals 12–15 and 18–21 on one side of the body 100 is connected to an associated connector 112–115 or 118–121 on the other side of the body 100 by a probe-shaped connector conductor passing through the body, such as that indicated at 213 for the input contact terminal 13 and input connector 113 as shown in FIG. 7. Similarly, a connector conductor 220 connects the output contact terminal 20 to its associated output connector 120 carried on the bottom cover 104 of the matrix switch 10. Each probe conductor is embedded in an insulated material 280 such as a bead of teflon which insulates the probe conductor from the surrounding body 100.

To connect the input connector 113 to the output connector 120, the reed conductor 29 is moved down to engage both the input contact terminal 13 of the connector conductor 213 and the output contact terminal 20 of the connector conductor 220. In this manner, a complete electrical circuit is made from the input connector 113 to the output connector 120. To actuate the reed conductors, the matrix switch 10 has a plurality of dielectric pusher elements such as that indicated at 129 for the reed conductor 29. As shown in FIG. 2, the dielectric pusher elements are carried on the top cover 102 and each has a stem 282 (FIG. 7) which extends through the matrix cover 102. As best seen in FIG. 7, each conductor reed depends from a pusher element stem 282 and is moved either up or down by the corresponding movement of the stem 282 of the associated pusher element.

Figure 5:
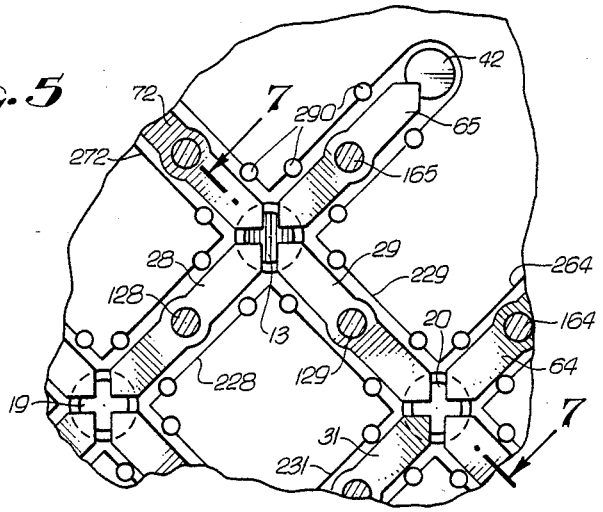
FIG. 5 is an enlarged top partial plane view of the reed conductors of FIG. 4.

The pusher elements may be actuated either manually or with the use of solenoids (not shown), for example. In one embodiment, energization of the solenoid can be used to force the dielectric pusher element and associated reed conductor down into the engaged position as illustrated for the element 129 and reed conductor 29 of FIG. 7. Upon deenergization of the solenoid, a spring 284 acting on the cap 286 of the pusher element returns the reed conductor to a disengaged position as illustrated for the conductor reed 66 and pusher element 166 of FIG. 7. To guide the reed conductors in their up and down motion and prevent contact between the reed conductors and the walls of the surrounding cavities, the matrix switch 10 further has a plurality of dielectric guide pins 290 as shown in FIGS. 5 and 7.

Referring now to FIGS. 1 and 4, it can be seen from the foregoing that the input connector 112 may be readily connected to either of the output connectors 118 or 119 by actuation of the appropriate reed conductor 24 or 25. Similarly, the input connector 113 may be connected to either the output connector 119 or the output connector 120 by actuation of the reed conductor 28 or reed conductor 29. Input connector 114 can be connected to either output connectors 118, 119 or 121 by actuation of the appropriate reed conductor 26, 27 or 32. Finally, input connector 115 may be connected to output connector 119, 120 or 121 by actuation of the reed conductor 30, 31 or 33. Because the input connector 115 is located adjacent to three (3) output connectors 119, 120 and 121 in the grid, only a single reed conductor at a time need be actuated to electrically interconnect input connector 115 with one of those three (3) output connectors.

Figure 6:
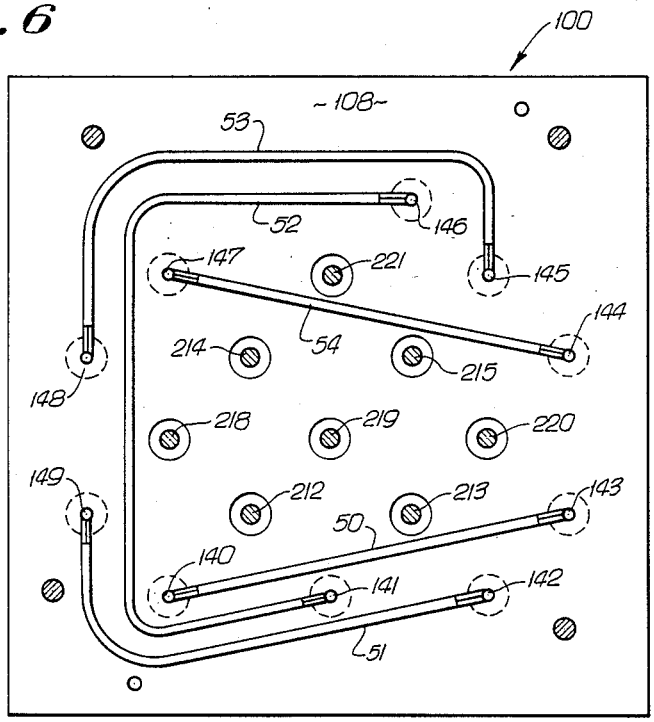
FIG. 6 is a bottom cross-sectional view of the switch of FIG. 2 viewed along the lines 6—6 of FIG. 2 and illustrating the coaxial lines interconnecting the transfer conductors of the switch of FIG. 2.
Figure 8A:
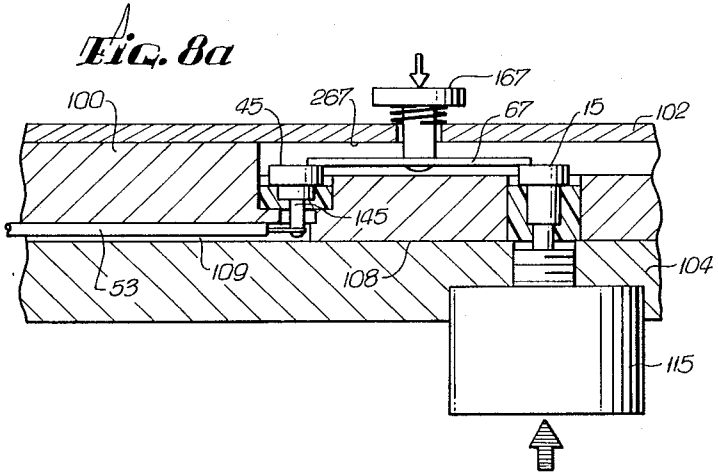
FIGS. 8*a* and 8*b* are cross-sectional views of the reed conductors, connector conductors and transfer conductors of the switch of FIG. 4 viewed along the lines 8*a*—8*a* and 8*b*—8*b*, respectively.
Figure 8B:
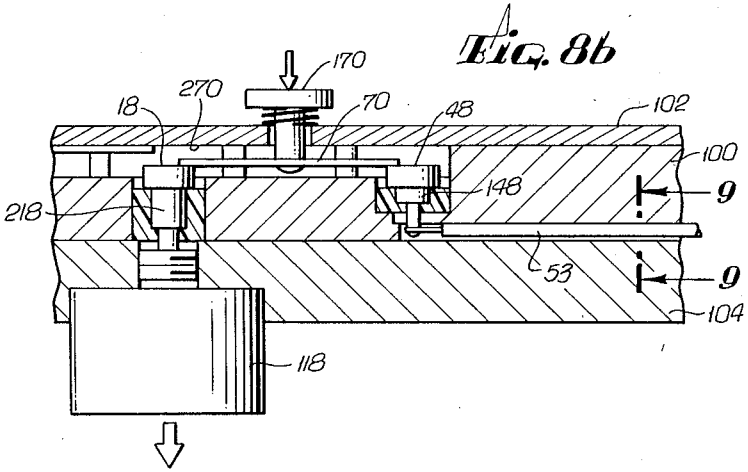

To connect the input connector 115 to the output connector 118 which is not located adjacent to the input connector 115 in the grid, the matrix switch 10 has a transfer contact terminal 45 which is placed adjacent to the input contact terminal 15. The input contact terminal may be electrically connected to the transfer contact terminal 45 by actuating a transfer reed conductor 67 to engage both the terminals 15 and 45 as shown in FIG. 8*a*. The transfer contact terminal 45 is connected by another probe-shaped conductor, transfer conductor 145, to the back side 108 of the body 100. As best seen in FIG. 6, the transfer conductor 145 is connected by a connecting line 53 on the back surface 108 of the body 100 to a second transfer conductor 148 which carries the transfer contact terminal 48 as shown in FIG. 8*b*. The transfer contact terminal 48 is adjacent the output contact terminal 18 such that upon actuation of a transfer reed conductor 70, engaging both the transfer contact terminal 48 and output contact terminal 18, the transfer conductor 148 is electrically connected via the transfer reed conductor 70 and the output connector conductor 218 to the output connector 118. Accordingly, the input connector 115 may be electrically connected to the output connector 118 by actuating the transfer reed conductors 67 and 70.

In a similar fashion, the input connector 114 may be electrically connected to the output connector 120 by actuating the transfer reed conductors 69 and 66. The input connector 112 may be connected to the output connector 120 by actuating the transfer reed conductors 62 and 64, or to the output connector 121 by actuating the transfer reed conductors 63 and 68. The input connector 113 may be connected to the output connector 118 by actuating the transfer reed conductors 65 and 71, or to the output connector 121 by actuating the transfer reed conductors 72 and 68.

Figure 9:
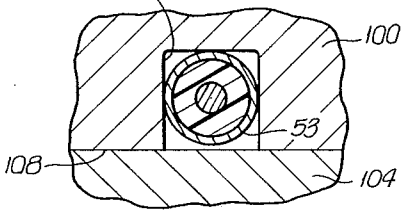
FIG. 9 is a cross-sectional view of the coaxial line of FIG. 8*b* viewed along the lines 9—9.

In the illustrated embodiment, each of the connecting lines 50–54 are formed from a semi-rigid coaxial cable as shown in FIG. 9. Each connecting cable such as cable 53 is nestled in a channel 109 on the back side 108 of the body 100.

Figure 10:
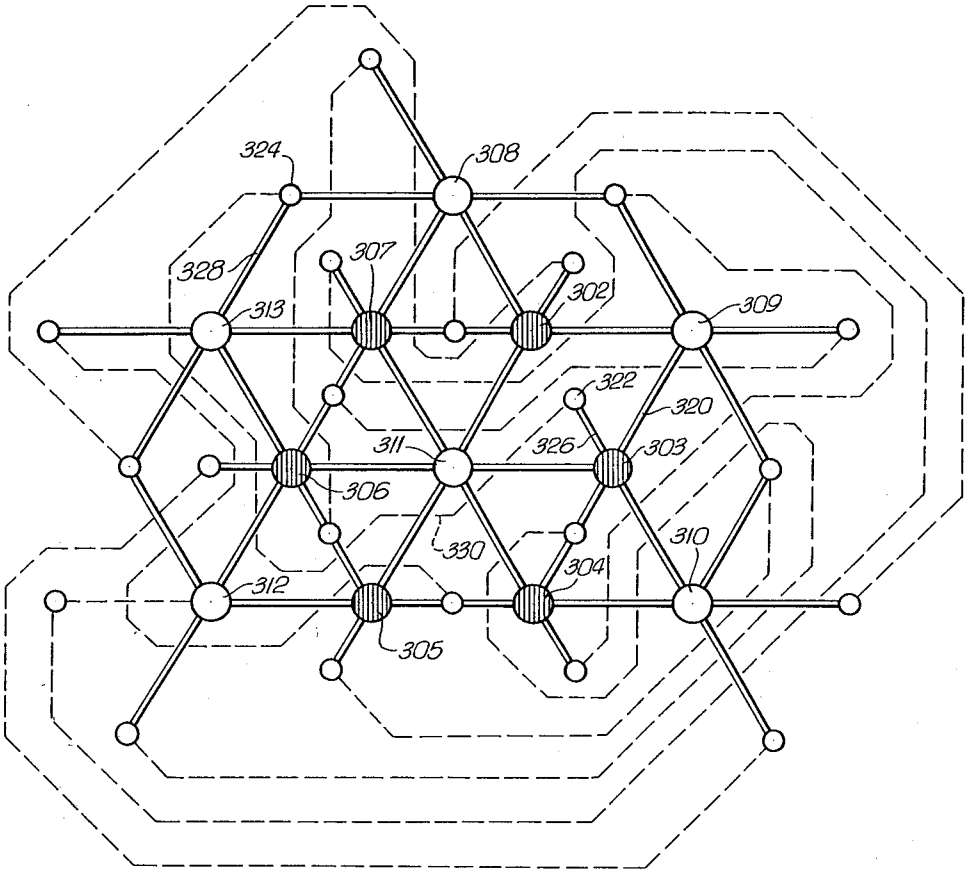
FIG. 10 is a schematic diagram of a 6×6 input matrix in accordance with an alternative embodiment.

FIG. 10 is a schematic representation of a 6×6 matrix switch in accordance with another embodiment of the present invention. The matrix switch 300 has six (6) inputs 302–307 and six (6) outputs 308–313. As shown in FIG. 10, the inputs and outputs are arranged in a grid so that adjacent inputs and outputs can be connected upon actuation of a single reed conductor. For example, the input 303 may be electrically connected to the output 309 upon actuation of the reed conductor 320. For outputs not adjacent to the inputs, the matrix switch 300 has a plurality of transfer contact terminals such as that indicated at 322 and 324 in FIG. 10. To save space, the transfer contact terminals adjacent the inputs are spaced more closely than the transfer contact terminals adjacent the outputs. Consequently, shortened transfer reed conductors such as that indicated at 326 are used to electrically connect an input to an adjacent transfer contact terminal.

To connect the outputs to an adjacent transfer contact terminal, the matrix switch 300 has additional transfer reed conductors such as that indicated at 328 which are of the same length as the reed conductors 320. Thus, to connect the input 303 to the output 313, for example, which are not adjacent, the shortened transfer reed conductor 326 is actuated, coupling the input 303 to the transfer contact terminal 322 which is connected by a connector line 330 to the transfer contact terminal 324. Upon actuation of the transfer reed conductor 328, the connection from the input 303 to the output 313 is completed.

Figure 11:
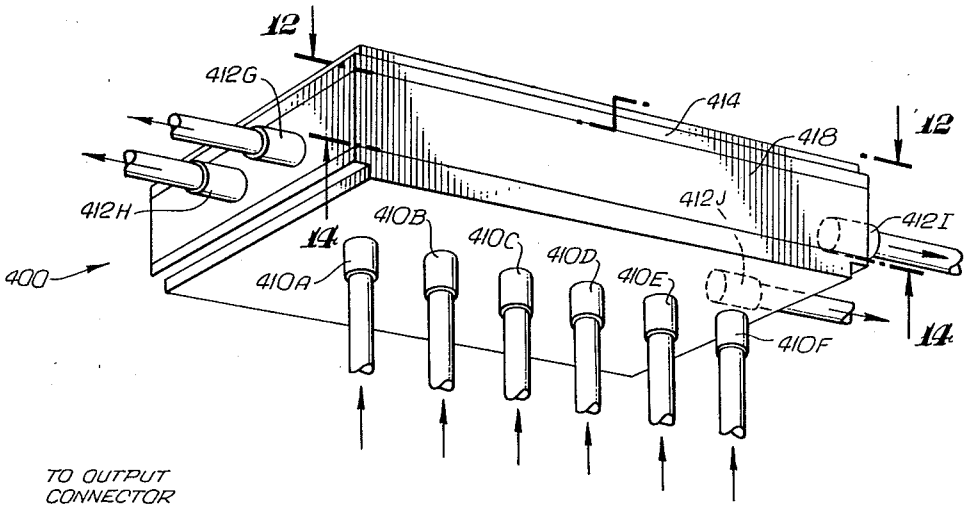
FIG. 11 is an isometric view of another alternative embodiment of the present invention, illustrating a 6×4 matrix switch.

FIG. 11 shows still another embodiment of a matrix switch in accordance with the present invention. The matrix switch, indicated generally at 400, is a 6×4 matrix having six (6) input connectors 410A–410F and four (4) output connectors 412G–412J. An input signal received at one of the six (6) input connectors 410A–410F may be routed to any one of the four (4) output connectors 412G–412J. The functions of the connectors 410A–410F and 412G–412J, like the previously discussed matrices, may be reversed. Thus, an input signal received at any one of the four (4) connectors 412G–412J may be routed to any one of the six (6) connectors 410A–410F. For RF applications, any one input should not be connected to more than one output.

Figure 12:
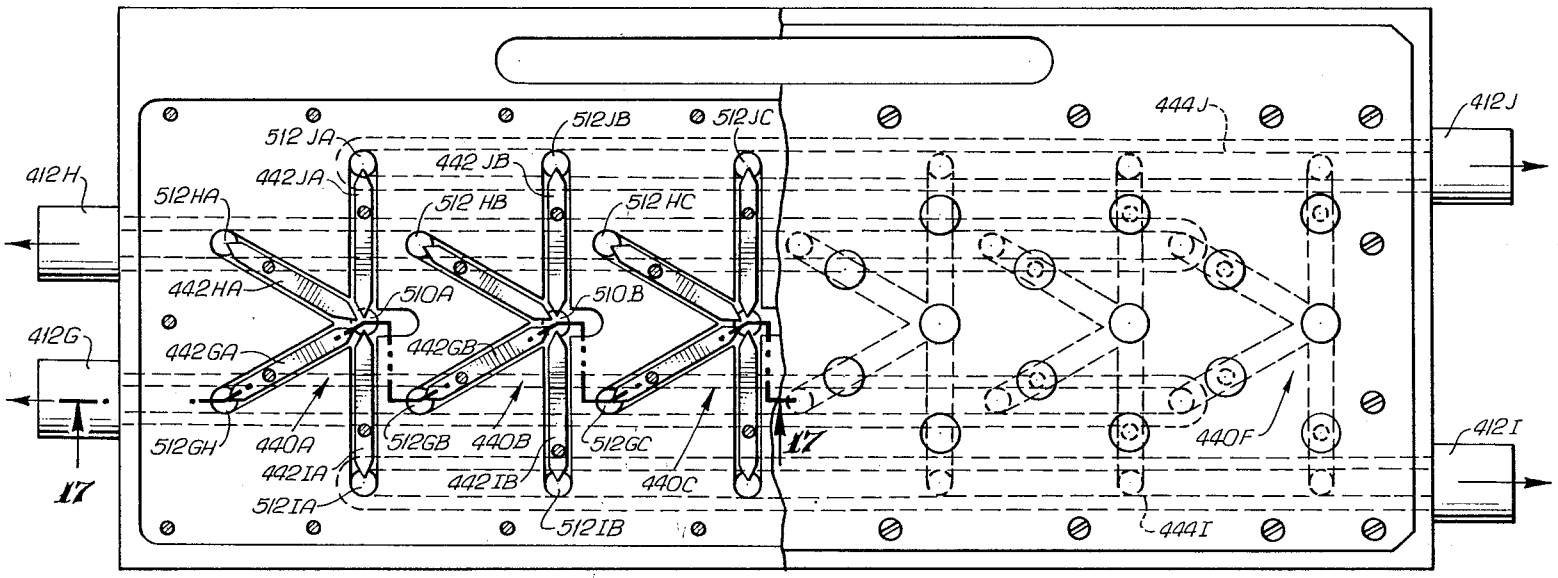
FIG. 12 is a top plan partial cross-sectional view of the switch of FIG. 11 illustrating the top reed conductors of the switch of FIG. 11.

FIG. 12 shows a top view of the matrix switch 400 with a portion of the top cover 414 broken away to show the top surface 416 of the matrix switch body 418. As shown therein, the matrix switch 400 includes six (6) single pole, four (4) throw input switches 440A–440F. Each input switch has an input contact terminal 510A–510F which is connected by a connector conductor 610A–610F (FIG. 17) to the associated input connector 410A–410F (FIG. 11). Each input switch has four (4) output contact terminals such as those indicated at 512GA, 512HA, 512IA and 512JA for the single pole, four (4) throw switch 440A, for example. The four output contact terminals for the single pole, four (4) throw switch 440B are designated 512GB, 512HB, 512IB and 512JB, and the four (4) output contact terminals for the single pole, four (4) throw switch 440C are designated 512GC, 512HC, 512IC and 512JC, and so on.

The input contact terminal of each single pole, four (4) throw input switch may be connected to any one of the four (4) output contact terminals of the switch by means of four (4) actuable reed conductors such as those indicated at 442GA, 442HA, 442IA and 442JA for the input switch 440A. Thus, to electrically couple the input contact terminal 510B to the output contact terminal 512GB of the input switch 440B, for example, the reed conductor 442GB is moved into an engaged position, engaging both the input contact terminal 510B and output contact terminal 512GB as shown in FIG. 17.

In accordance with one aspect of the present invention, one output contact terminal of each of the input switches 440A–440F is associated with one of the four (4) output connectors 412G–412H by one of four (4) multi-leaf spring reed lines such as those indicated in phantom at 444G–444J, respectively, in FIG. 12. Such an arrangement allows the input signal at each of the six input connectors 410A–410F to be routed to any one of the four (4) output connectors 412G–412J.

Figure 13:
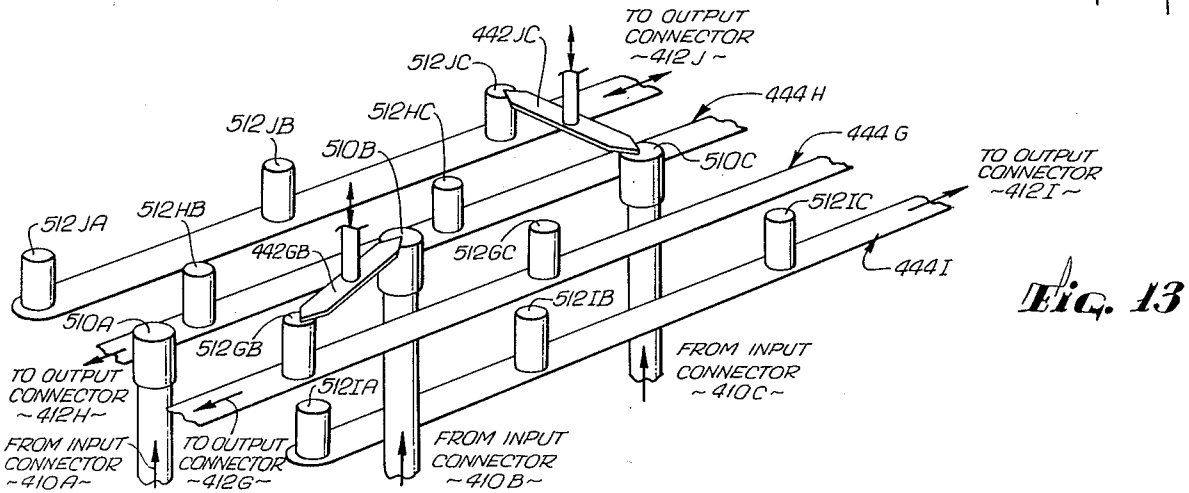
FIG. 13 is a schematic diagram illustrating the operation of the switch of FIG. 11.

The function of the reed lines 444G–444J may be more readily understood with reference to FIG. 13 which shows a partial schematic representation of the matrix switch 400. As shown therein, each reed line is coupled to one of the output connectors 412G–412J at one end and may be coupled to one of the four (4) output contact terminals 512 of each of the six (6) input switches 440A–440F. Consequently, by actuating the appropriate input switch reed conductor, the signal from an input connector may be routed to any one of the four (4) output connectors via the associated reed line. Thus, for example, the input contact terminal 510B of the input switch 440B may be coupled to the output connector 412G by actuating the reed conductor 442GB which connects the input contact terminal 510B to the output contact terminal 512GB and to the output connector 412G via the reed line 444G as shown in FIGS. 13 and 17. Alternatively, the input contact terminal 510B could be coupled to any one of the three (3) other output connectors 412H–412J by actuation of the appropriate input switch reed conductor and via one of the three remaining associated reed lines.

Figure 14:
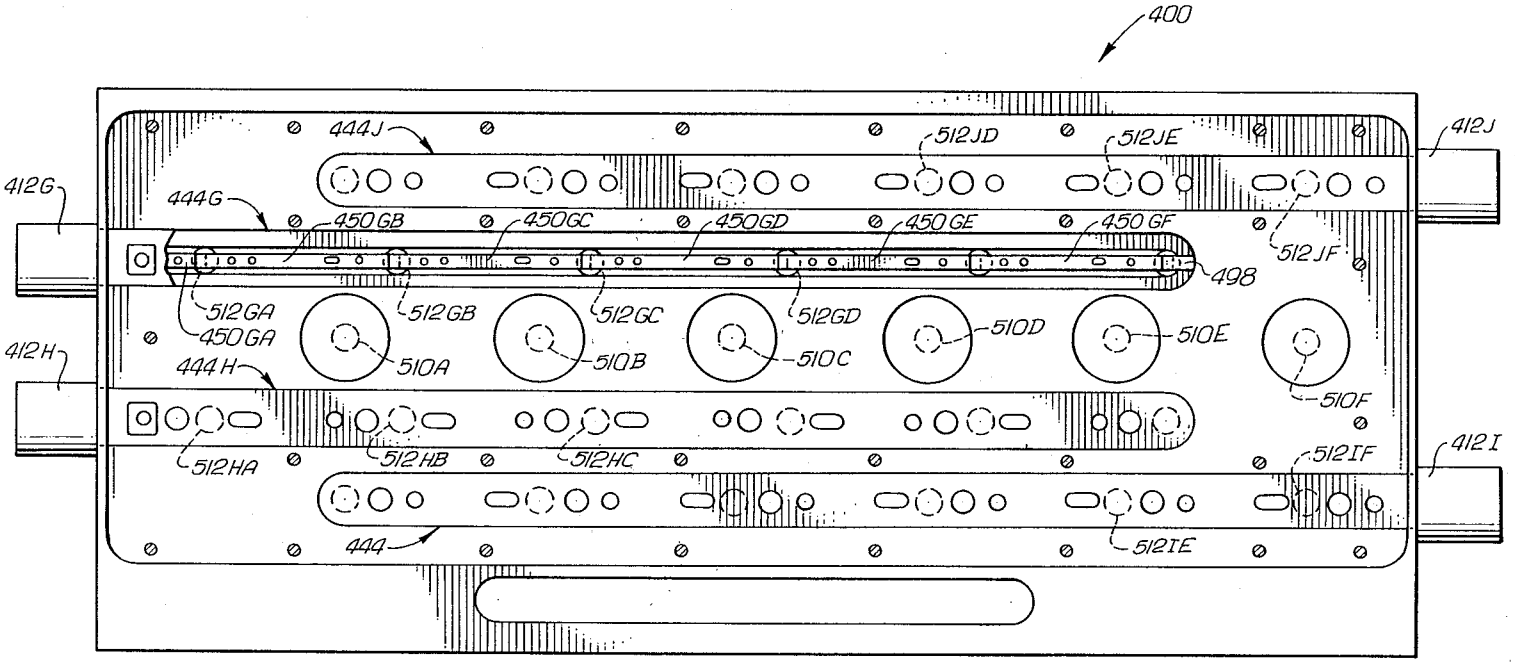
FIG. 14 is a bottom plan cross-sectional view of the switch of FIG. 11 viewed along the lines 14—14 of FIG. 11 and illustrating the reed lines of the switch of FIG. 11.
Figure 15:
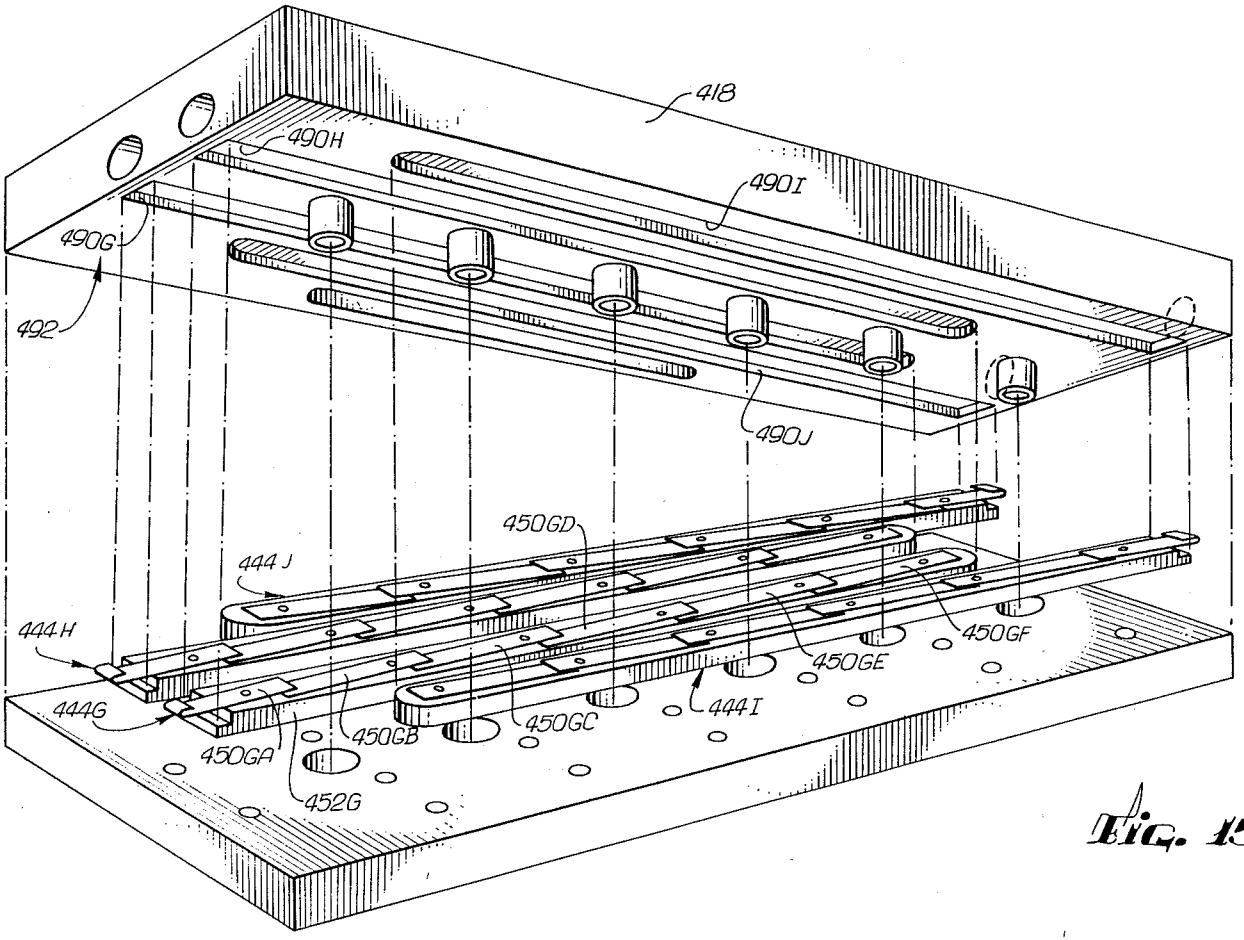
FIG. 15 is an exploded perspective view of the switch of FIG. 11.
Figure 16:
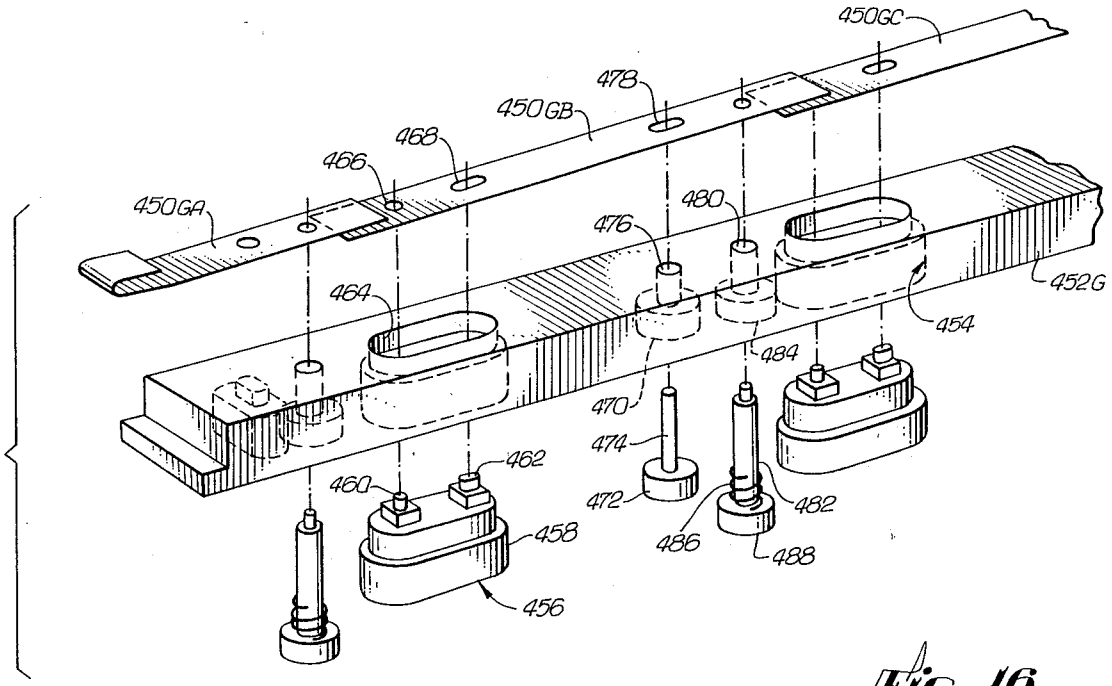
FIG. 16 is an exploded partial view of a reed line of the switch of FIG. 15.
Figure 17:
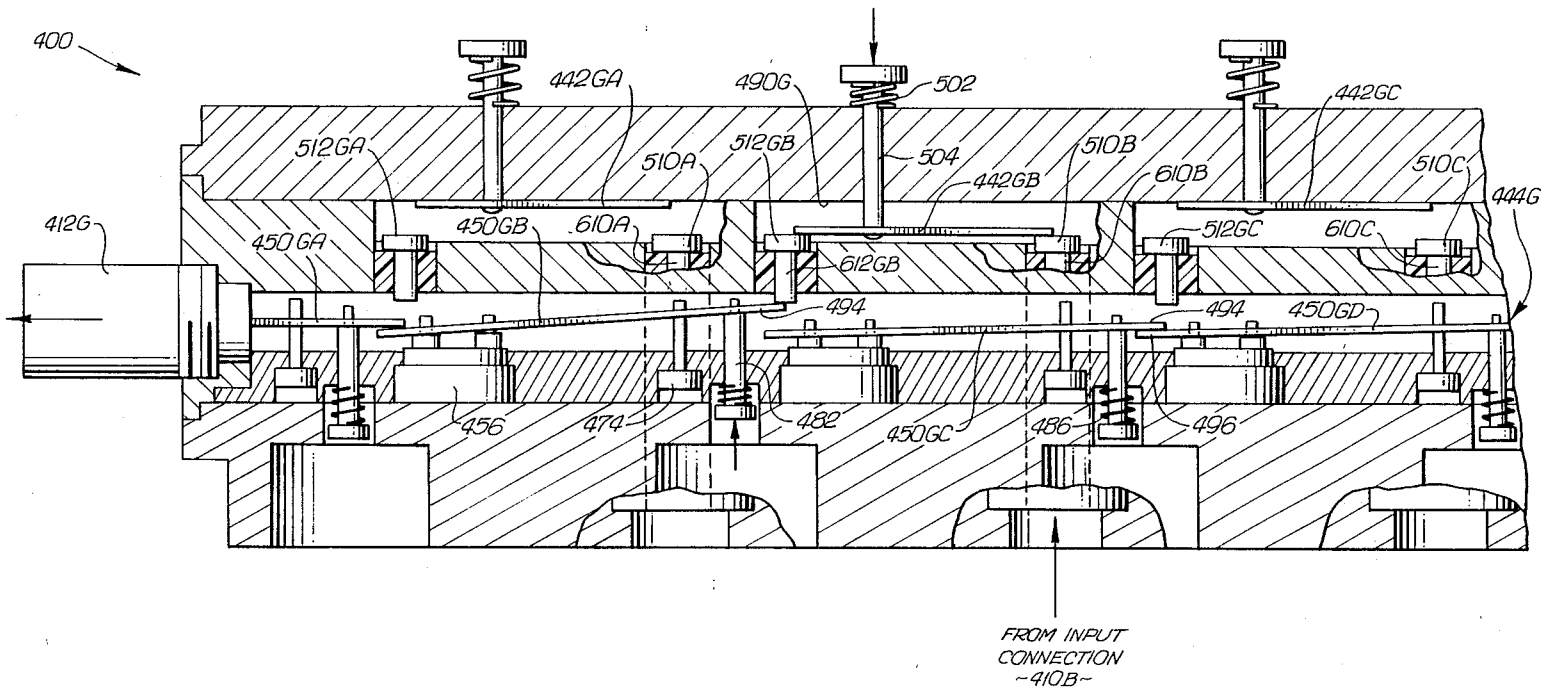
FIG. 17 is a partial cross-sectional view of the switch of FIG. 12 viewed along the lines 17—17 of FIG. 12 and illustrating the operation of a reed line.

The construction of the reed lines 444G–444J is shown in greater detail in FIGS. 14–17. As best seen in FIGS. 15 and 16, each reed line comprises six (6) overlapping leaf spring reed conductors such as those indicated at 450GA–450GF for the reed line 444G. The overlapping leaf spring reed conductors of each reed line are insulatively carried by a support plate such as that indicated at 552G for the reed line 444G. The support plate 452G has a plurality of generally oval-shaped recesses on the back side, which is adapted to receive and seat a dielectric mounting member 456 having a base 458 and a pair of mounting pins 460 and 462. The mounting pin 460 has a circular cross-section and the mounting pin 462 has an oval cross-section. When the mounting member 456 is seated in the support plate 452 as shown in FIG. 17, the mounting pins 460 and 462 extend through an aperture 464 (FIG. 16) in the support plate 452. Each leaf spring reed conductor with the exception of the first reed conductor 450 A of each reed line, has a pair of mounting holes 468 (FIG. 16) at one end which are adapted to receive the mounting pins 460 and 462 of the mounting member 456 as shown in FIG. 17.

Each support plate 452 has a second recess 470 which is adapted to receive the base 472 of a guide pin 474. When seated, the guide pin 474 extends through an aperture 476 in the guide plate as shown in FIG. 17. Each leaf spring reed conductor 450 has a guide slot 478 which is adapted to receive the guide pin 474.

Finally, the support plate 452G has another aperture 480 for each of the leaf spring reed conductors of the reed line, through which an actuator pin 482 extends and engages the associated leaf spring reed conductor at its other end. Adjacent the aperture 480 in the support plate 452G is recess 484 which seats a return spring 486 engaging the base 488 of the actuator pin 482. Each leaf spring reed conductor is secured to the associated mounting pins 460 and 462 and actuator pin 482 by means of a suitable adhesive such as a teflon bead.

FIG. 15 shows the four (4) reed lines 444G–444J assembled and ready to be joined with the body 418 of the matrix switch 400. As shown therein, the body 418 has four (4) linear cavities 490G–490J on the underside 492 of the body 418, which are adapted to receive and seat the reed lines 444G–444J, respectively. When mounted in the body 418 of the matrix switch 400, each reed line 444G–444J is connected to its associated output connector 412G–412J. Thus, as shown in FIG. 17, for example, the first leaf spring reed conductor 450GA of the reed line 444G is connected to the output coaxial connector 412G.

As best seen in FIGS. 12 and 14, the body cavities 490G–490J and the associated reed lines 444G–444J are aligned in registration with the output contact terminals 512GA–512EF of the input switches 440A–440F. More specifically, output contact terminal for each input switch is aligned in registration with one of the leaf spring reed conductors of a particular reed line. Thus, for example, the output contact terminal 512GA of the input switch 440A is aligned in registration with the underlying leaf spring reed conductor 450GA of the reed line 444G; the output contact terminal 512GB of the input switch 440B is aligned in registration with the next leaf spring reed conductor 450GB (FIG. 17) of the same reed line 444G, etc. as shown in FIG. 14.

When unactuated, the leaf spring reed conductors of a particular reed line engage each other serially in an overlapping fashion so that all the leaf spring reed conductors of the reed line are electrically connected in series. As best seen in FIG. 17, the actuator pin return spring 486 biases each leaf spring reed conductor 450 in the aforementioned overlapping, series-connected position. Thus, for example, FIG. 17 shows the contact end 494 of the leaf spring reed conductor 450GC pulled down to engage and overlap the mounted end 496 of the adjacent leaf spring reed conductor 450GD.

Referring now to FIG. 14, the last leaf spring reed conductor 450 F of each reed line engages a termination resistor rather than another leaf spring reed conductor when in the overlapping, unactuated position. For example, FIG. 14 shows the last leaf spring reed conductor 450GF of the reed line 444G engaging a termination resistor 498. Consequently, when all the leaf spring reed conductors of a particular reed line are in the overlapping, unactuated position, the associated output connector is connected to a termination resistor by the overlapping leaf spring reed conductors.

Alternatively, to connect one of the six (6) input connectors 410A–410F to one of the four (4) output connectors 412G–412J, all that is necessary is to actuate the appropriate input reed conductor of the associated input switch and actuate the appropriate leaf spring reed conductor of the reed line associated with the desired output conductor. For example, an RF signal from the input connector 410B is conducted to the input contact terminal 510B of the associated input switch 440B of FIG. 12. This RF signal may be conducted to any one of the four (4) output connectors 412G–412J upon actuation of the appropriate input switch reed conductor 442GB–442JB. For example, the signal at the input contact terminal 510B of the input switch 440B may be conducted to the output contact terminal 512GB associated with the output connector 412G by actuating the input switch reed conductor 442GB to engage both contact terminals 510B and 512GB as shown in FIGS. 13 and 17. Secondly, the actuator pin 482 (FIG. 17) coupled to the leaf spring reed conductor 450GB is actuated, causing the leaf spring reed conductor 450GB to bend upwards so that the contact end 494 of the leaf spring reed conductor 450GB engages and makes electrical contact with the transfer conductor 612GB which carries the output contact terminal 512GB. In this manner, a direct electrical connection is made from the output contact terminal 512GB to the output connector 412G via the transfer connector 612GB and the leaf spring reed conductors 450GB and 450GA of the reed line 444G.

It should be noted that the leaf spring reed conductor 450GB in the actuated position, disengages contact with the next-in-line leaf spring reed conductor 450GC of the reed line 444G. Consequently, the output conductor 412G is disconnected from the termination resistor coupled to the last unactuated leaf spring reed conductor 450GF of the reed line 444G.

Upon deactivation of the solenoid (not shown) actuating the leaf spring reed conductor 450GB, the return spring 486 of the leaf spring reed conductor 450GB returns the reed conductor 450GB back to the overlapping, series-connected position. Thus, the output connector 412G is uncoupled from the input switch 440B and is recoupled to the termination resistor at the end of the reed line 444G. Upon deactivation of the solenoid (not shown) actuating the input reed conductor 442GB, a return spring 502 drives the dielectric actuating pin 504 upward, disengaging the reed conductor 442GB from the contact terminals 510B and 512GB. A termination resistor (not shown) may then be moved into engagement with the input contact terminal 510B.

It is recognized that the number of inputs of the matrix switch 400 may be readily increased by adding input switches 440 and leaf spring reed conductors to the reed lines 444G–444H. Similarly, the number of outputs of the matrix switch can be increased by increasing the number of reed lines and increasing the number of outputs of the input switches.

It is seen from the above that the present invention provides a matrix switch which is economical to manufacture, low in weight and highly reliable. Furthermore, the improved design of the present invention allows the switch to be packaged very compactly.

It will, of course, be understood that modifications of the present invention, in its various aspects, will be apparent to those skilled in the art, some being apparent only after study and others being matters of routine electromechanical design. For example, it is recognized that the number of inputs and outputs of the switches may be changed. Still other embodiments are possible, with their specific designs depending upon the particular applications. As such, the scope of the invention should not be limited to the particular embodiments herein described but should be defined only by the appended claims and equivalents thereof.

What is claimed is:

1. An input/output RF matrix switch comprising:

a solid body provided with a plurality of apertures extending through the body;

a plurality of terminals externally disposed on one side of the body;

a plurality of probe conductors, each probe conductor received in an aperture and extending through the body, each probe conductor carrying one of the plurality of terminals;

a plurality of actuable conductors, each conductor being disposed on a side of the body and being movable between an actuated position wherein each actuable conductor engages and electrically couples two terminals together, and an unactuated position;

a plurality of input/output connectors disposed on a side of the body, each connector being electrically coupled to a probe conductor terminal; and a plurality of conductor lines disposed on a side of the body, each conductor line electrically coupling at least two probe conductors together;

wherein at least two connectors are selectively electrically couplable to each other via the probe conductors associated with the two connectors and the actuable conductor associated with the terminals of the two probe conductors and by moving the associated actuable conductor to the actuated position to engage and electrically couple the terminals of the two probe conductors associated with the two connectors, and wherein at least two other connectors are selectively electrically couplable together via a first probe conductor, a second probe conductor, a first actuable conductor associated with the terminals of the first and second probe conductors, a third probe conductor, a fourth probe conductor, a second actuable conductor associated with the terminals of the third and fourth probe conductors, and a conductor line electrically coupling the second and third probe conductors together and by moving the first and second actuable conductors to their actuated positions.

2. The matrix switch of claim 1 wherein the body defines a plurality of cavities, each cavity of sufficient size to receive an actuable conductor.

3. The matrix switch of claim 1 wherein each probe conductor comprises a conductive pin and an outer insulative layer received within an aperture of the body.

4. An input/output RF matrix switch comprising:

a plurality of input/output connectors;

a body;

a first plurality of terminals carried by the body, each terminal being electrically insulated from the remaining plurality of terminals and electrically connected to an input/output connector;

a second plurality of terminals carried by the body, each of the second plurality of terminals being electrically insulated from the remaining second plurality of terminals;

a plurality of conductor lines for electrically connecting pairs of the second plurality of terminals;

a first plurality of actuable conductors, each actuable conductor being movable between an actuated position wherein each actuable connector electrically couples two terminals together and an unactuated position; and a second plurality of actuable conductors, each actuable conductor being movable between an actuated position wherein each actuable conductor of the second plurality electrically couples a connector terminal and a conductor line terminal together and an unactuated position;

wherein two connectors are selectively electrically connected to each other via two connector terminals associated with the two connectors and an actuated conductor of the first plurality of actuable conductors electrically coupling said two connector terminals together, and wherein a second pair of connectors may be selectively electrically connected together via a connector terminal associated with one of the second pair of connectors, a conductor line terminal, an actuated conductor coupling the connector terminal and conductor line terminal together, a second conductor terminal electrically connected to the first conductor terminal, a second actuable conductor actuated to electrically couple the second conductor terminal to the connector terminal associated with the other connector of the second pair.

5. The switch of claim 4 wherein the connector terminals and conductor line terminals are arranged in a grid.

6. An input/output RF matrix switch comprising:

a body;

a plurality of input switches disposed on one side of the body, each switch having an input terminal, a plurality of output terminals, and a coupling means for selectively coupling the input terminal to one of the plurality of output terminals;

a plurality of reed lines disposed on the body, each reed line comprising an output terminal and a plurality of movable reed conductors one of which is coupled to the reed line output terminal, each reed conductor being positioned in registration with an output terminal of the input switches and further being movable between a first position wherein the reed conductor engages the output terminal of the associated switch and a second position wherein the reed conductor engages another reed conductor, so as to electrically couple the output terminal of the associated switch to the reed line output terminal when the reed conductor is in the first position and one of more of the remaining reed conductors is in the second position.

7. The matrix switch of claim 6 wherein the body defines a plurality of cavities, each cavity of sufficient size to receive a reed line.

8. The matrix switch of claim 6 wherein the coupling means further comprises a second plurality of actuable reed conductors, each reed conductor being associated with an output terminal of an input switch and being movable between an engaged position wherein the reed conductor engages and electrically couples the input terminal and the output terminal of the associated switch, and a disengaged position.

9. The matrix switch of claim 6 wherein the reed conductors of each reed line comprises a plurality of overlapping leaf spring conductors serially coupled together when in the first engaged position.

10. An input/output RF matrix switch comprising:

a body having two sides;

a plurality of input connectors;

a plurality of output connectors;

a plurality of input connector conductors extending through the body, each input connector conductor having a terminal at one end and being electrically connected to an input connector at the other end;

a plurality of transfer conductors extending through the body, each transfer conductor having a terminal at each end;

a first plurality of actuable conductors, each actuable conductor being disposed on one side of the body and being movable between an engaged position engaging the terminals of one of the input connector conductor terminals and one of the transfer conductor terminals, and a disengaged position, wherein each actuable conductor is actuable to electrically couple an input connector conductor terminal to a transfer conductor terminal on one side of the body;

a plurality of reed lines disposed on the other side of the body, each reed line comprising a plurality of leaf spring conductors, one of which is coupled to an connector, each leaf spring reed conductor being positioned in registration with the terminal of a transfer conductor and being movable between a first actuated position wherein the reed conductor engages the terminal of the associated transfer conductor and a second position wherein the reed conductor engages another reed conductor;

wherein an input connector can be electrically coupled to an output connector by actuation of an actuable conductor on one side of the body and a leaf spring reed conductor on the other side of the body.

11. The switch of claim 10 wherein each reed line and the transfer conductors associated with each reed line are linearly aligned in registration with each other.

12. The switch of claim 11 wherein the body defines a first plurality of cavities, each cavity having sufficient size to receive an actuable conductor on the one side of the body each of said actuable conductors being electrically insulated from the others, and a second plurality of cavities on the other side of the body, each of the second plurality of cavities being adapted to receive a reed line and each of said reed lines being electrically insulated from the others.

* * * * *